United States Patent [19]

Gordon

[11] 4,150,747

[45] Apr. 24, 1979

[54] COMPOSITE CAN

[75] Inventor: Gerald A. Gordon, Skokie, Ill.

[73] Assignee: The Continental Group, Inc., New York, N.Y.

[21] Appl. No.: 794,883

[22] Filed: May 9, 1977

[51] Int. Cl.[2] ..... B65D 5/72; B65D 17/02; B65D 17/16

[52] U.S. Cl. ..... 206/603; 206/616; 220/404; 222/83; 229/4.5

[58] Field of Search ..... 206/603, 616, 222; 229/14 B, 5.5, 4.5; 222/80, 83, 85; 220/403, 404, 410

[56] References Cited

U.S. PATENT DOCUMENTS

| | | | |
|---|---|---|---|
| 1,732,282 | 10/1929 | Sage | 206/616 |
| 2,617,559 | 11/1952 | Van Der Spek | 222/83 |
| 3,042,286 | 7/1962 | Pottle | 229/4.5 |
| 3,170,601 | 2/1965 | Daley | 229/14 B X |
| 3,187,918 | 6/1965 | Moore | 222/83 X |
| 3,434,651 | 3/1969 | Stec | 229/5.5 |
| 3,548,562 | 12/1970 | Schwartzman | 222/80 X |
| 3,779,372 | 12/1973 | de Lloret | 206/222 |

FOREIGN PATENT DOCUMENTS

| | | | |
|---|---|---|---|
| 558742 | 2/1975 | Switzerland | 206/222 |

*Primary Examiner*—Stephen P. Garbe
*Attorney, Agent, or Firm*—John J. Kowalik; Joseph E. Kerwin; Charles E. Brown

[57] ABSTRACT

A composite container comprising a rigid cylindrical sidewall, an end closure integrally attached to the sidewall, a product-compatible liner disposed within said sidewall, and a cutter element, carried between the sidewall and the liner, for rupturing the liner to permit passage of product therethrough. The end closure is formed of a distal end portion of the sidewall folded into a plurality of interconnected triangular segments disposed transverse the principal axis of the container and arranged to be reformable into a pouring spout. A grasping element is attached to both the cutter element and the end closure, such that the end closure may be opened, the pour spout erected and the liner ruptured in a single operation.

19 Claims, 9 Drawing Figures

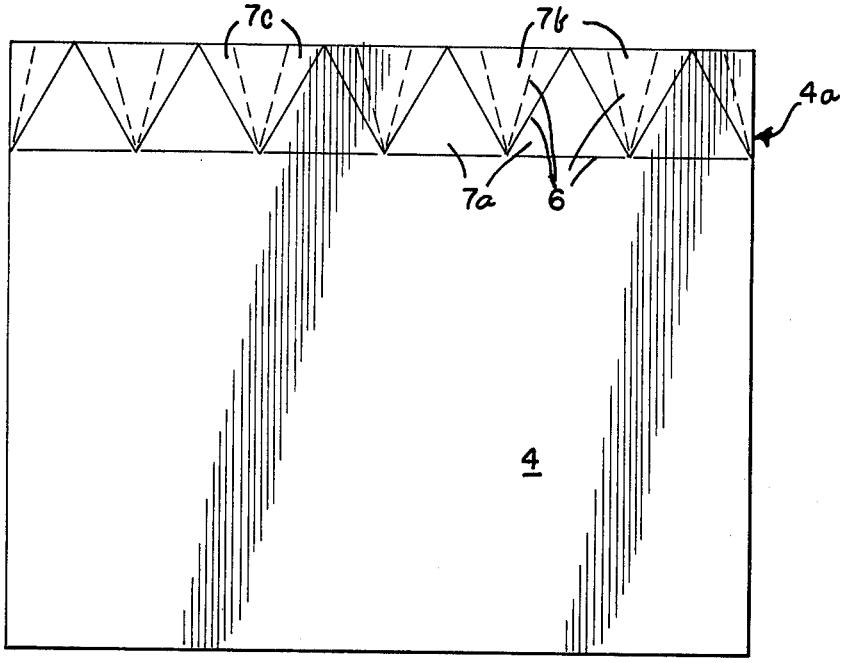
FIG. 1.
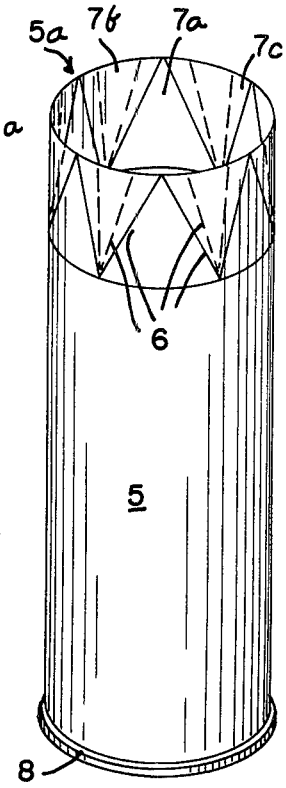
FIG. 2.
FIG. 4.
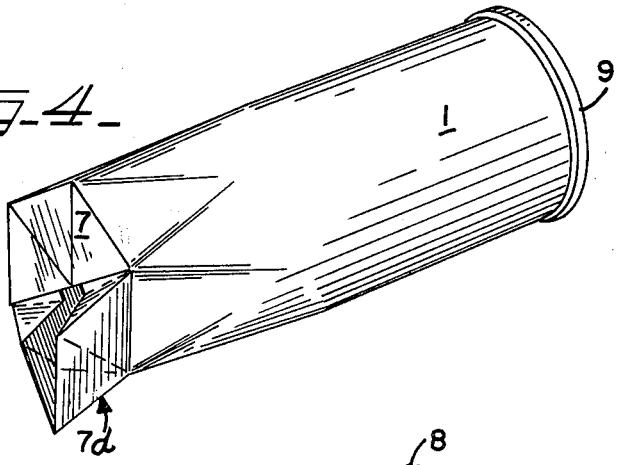
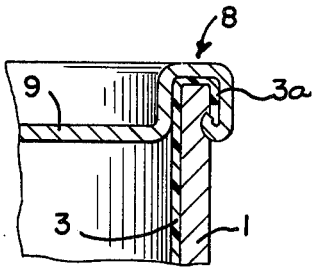
FIG. 6.
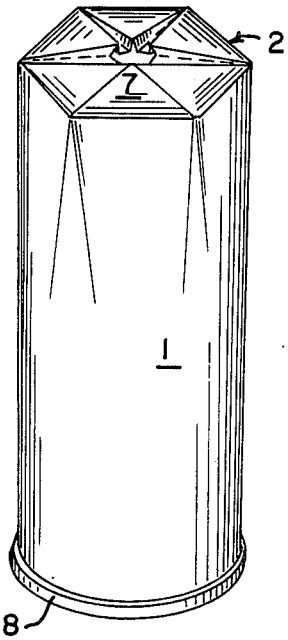
FIG. 3.

COMPOSITE CAN

BACKGROUND AND SUMMARY OF THE INVENTION

The present invention relates to containers and, more specifically, to a paperboard container for fluent materials.

Packaging of fluent materials in containers formed of paperboard or like materials is well known in the art as, for example, Hollingshead U.S. Pat. No. 2,603,400, Kasdorf U.S. Pat. No. 2,126,116 and Meyer-Jagenberg U.S. Pat. No. 1,915,027. Such containers, however, suffer, to varying degrees, from problems relating to leakage, difficulty of opening, poor stackability, and poor pourability. The pouring problem is alleviated, to some extent, in containers having an erectable pouring spout, such as McGinnis U.S. Pat. No. 2,593,778, Davidson Jr. et al U.S. Pat. No. 2,327,024 and Karlsson-Ygger U.S. Pat. No. 2,058,592. Likewise, the openability problem has been attacked in containers such as Martin U.S. Pat. No. 2,325,145 and Milmoe U.S. Pat. No. 3,019,191 which include end closures having a self-opening feature.

Despite these efforts, no paperboard container, with the exception of a few specialized containers such as milk cartons, has gained substantial market acceptance for the packaging of fluent products. Rather, a compromise solution has been widely adopted, comprising the combination of a paperboard body or sidewall and metal end panels in what is commonly known as a "composite can". However, the increasing cost of metal, relative to paperboard, has now reduced the attractiveness of this compromise.

It is therefore a primary object of the present invention to provide a container for fluent products, formed substantially of paperboard or like materials, which offers increased leak resistance.

It is another object to provide such a container which may be opened easily without the need for an opener or other implement.

It is yet another object to provide such a container which may be readily stacked and from which product may be poured in a precisely controlled, manner.

It is still another object to provide such a container which may be employed for packaging a wide variety of products while retaining a high degree of container commonality.

BRIEF DESCRIPTION OF THE DRAWINGS

The above and other objects as may hereinafter appear may be more clearly understood by reference to the drawings wherein:

FIG. 1 is a plane view of a paperboard or similar blank for the container of the present invention.

FIGS. 2 and 3 are perspective views showing two stages in the formation of the end closure of the present invention.

FIG. 4 is a perspective view showing the end closure opened and reformed as a pour spout.

FIG. 6 is an enlarged, fragmentary cross-sectional view of the circled area of FIG. 5.

BRIEF DESCRIPTION OF THE PREFERRED EMBODIMENT

Figure 5:
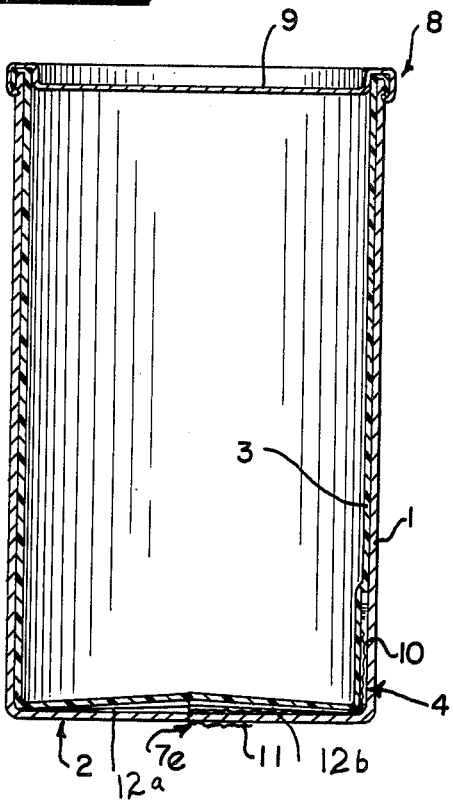
FIG. 5 is a diametrical cross-sectional view of the container of the present invention.
Figure 8:
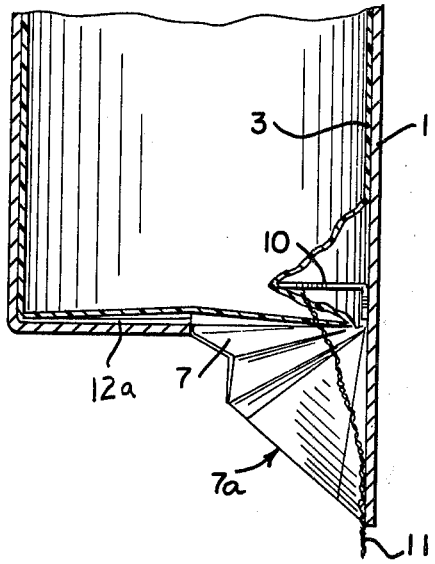
FIG. 8 is a fragmentary diametrical cross-sectional view, illustrating the container end closure in a partially opened state.
Figure 7:
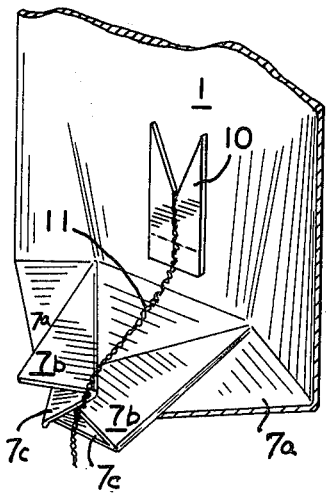
FIG. 7 is a fragmentary perspective view of a portion of the container sidewall having attached thereto a rupturing member.
Figure 9:
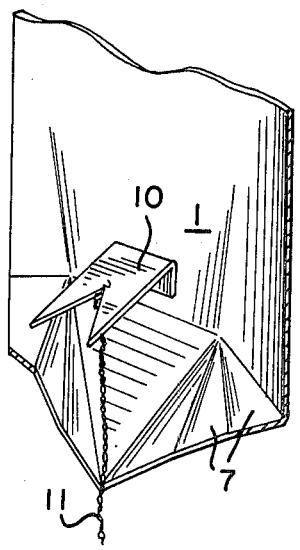
FIG. 9 is a fragmentary perspective view illustrating the container end closure in a partially opened state.

As best seen in FIG. 5, the composite container of the present invention comprises a rigid cylindrical sidewall 1, an end closure 2 integrally attached to the sidewall 1, a liner 3 disposed within the sidewall 1, and a cutter element 10, carried between the sidewall 1 and the liner 3, for rupturing the liner 3 to permit passage of product therethrough.

As shown in FIGS. 1–3, the sidewall 1 and end closure 2 may be formed from a rolled rectangular blank 4, or seamless cylinder 5, of paperboard or similar material. An edge portion 4*a* or 5*a* of the rolled blank 4 or cylinder 5, is adapted to be folded along fold lines 6 to form an interconnected series of triangular segments 7, disposed transverse the principal axis of the container (see FIG. 3) in a substantially planar configuration.

The triangular segments 7 comprise N large isosceles triangles 7*a*, N small isosceles triangles 7*b*, and 2N obtuse triangles 7*c*, where N is an even integer, preferably, but not necessarily, 6 (note: when N=6, the large isosceles triangles are equilateral). The obtuse triangles 7*c* flank the small isosceles triangles 7*b* and add thereto to form triangles congruent and opposingly interspaced with the large isosceles triangles 7*a*.

In the completed end closure 2, the triangles 7 are folded into superposed relation, with the obtuse triangles 7*c* lying between the large isosceles triangles 7*a* and the small isosceles triangles 7*b*. Preferably, the large isosceles triangles 7*a* are outermost, whereby the minimum number of folds is presented to view and larger unbroken areas are provided for printing of opening instructions or decorative matter.

The small isosceles triangles 7*b* are adhesively fastened to adjacent obtuse triangles 7*c* to retain the end closure 2 in a closed condition prior to opening thereof. The adhesive bonds 12 are of two types, the first type 12*a* being comparatively permanent, while the second type 12*b* is adapted for debonding to open the end closure 2. Each type of bond 12 is preferably applied to one half of the end closure 2 as best seen in FIG. 3.

In opening of the end closure 2, the segments 7 associated with the bonds 12*b* of the second type are drawn outwardly from the container by means more fully described hereinafter, to a position whereat they comprise an integral pour spout 7*d* coterminous with an opening in the end closure 2 (see FIG. 4).

A product-compatible liner 3, disposed within the sidewall 1, comprises an impervious barrier for leakproof retention of product. As best seen in FIG. 6, the peripheral edge portion 3*a* of the liner 3 is caught in the crimped connection 8 between the sidewall 1 and a planar, a preferably metallic, end panel 9.

The rupturing means comprises a cutter element 10 hingedly attached to the sidewall 1 and a flexible grasping element 11 attached to the cutter element 10 and extending through the meeting point 7*e* of the triangular segments 7 to the exterior of the container whereat it may be readily grasped. The grasping element 11 is also adhesively attached to one or more of the triangular elements 7 adapted to comprise a portion of the pour spout 7*d*. Thus, when the grasping element 11 is pulled, the triangular segments 7 associated with the second type 12*b* of adhesive bond are drawn outwardly, establishing an opening in the end closure 2, and forming the pour spout 7*d*. At the same time, the cutter element 10 is drawn against the liner 3, rupturing the same, thereby providing for the passage of product therethrough. It is to be noted that this opening procedure is accomplished by a single displacement of the grasping element 11.

The container as described is particularly well suited for packaging of automotive products, especially engine oil. When sold at service stations, the container may be opened, if so desired, by applying the standard combination opener and pour spout to the metal end panel 9 in the manner well known to mechanics and other autocare professionals, or, alternatively, it may be opened in the manner described above.

The present container offers further advantages in that the substantial planar end closure 2 and end panel 9 allow ready stacking.

By selection of the proper liner material, the container may be successfully employed for packaging of a wide variety of products with a high degree of container commonality.

I claim:

1. A container comprising a rigid cylindrical sidewall, defined about a principal axis, an end closure integrally attached to said sidewall, a product compatible liner disposed within said sidewall, and movable rupturing means pivotally mounted on said sidewall and swingable away from said sidewall into rupturing contact with said liner for rupturing said liner to permit passage of product therethrough, and a manually operable flexible pull member attached to said rupturing means for swinging the same.

2. The container of claim 1, wherein said end closure, prior to opening, lies substantially in a plane perpendicular to the principal axis of the container, whereby an object, having a planar base may be readily stacked upon said container.

3. A container comprising a rigid cylindrical sidewall, defined about a principal axis, an end closure integrally attached to said sidewall, a product compatible liner disposed within said sidewall, and means carried between said sidewall and said liner for rupturing said liner to permit passage of product therethrough, wherein said end closure comprises a distal end portion of said sidewall folded into a plurality of interconnected triangular segments disposed transverse the principal axis of the container to form an N side polygon where N is an integer, said triangles comprising N comparatively large isosceles triangles, N comparatively small isosceles triangles and 2 N obtuse triangles, said triangles being folded in superposed relation in said end closure, with said obtuse triangles lying between said large isosceles triangles and said small isosceles triangles.

4. The container of claim 3, wherein a number of said segments may be refolded to form a pour spout coterminous with an opening in said end closure.

5. The container of claim 3, wherein said small isosceles triangles are adhesively fastened to adjacent obtuse triangles.

6. The container of claim 5, wherein the adhesive bonds are of two types, the first type being comparatively permanent, the second type being adapted for debonding, whereby the triangles associated with said second type of bond may be debonded, unfolded and reformed into a pour spout subsequent to opening of said end closure.

7. The container of claim 1, wherein said rupturing means comprises a cutter element hingedly attached to said sidewall and a flexible grasping element attached to said cutter element and extending to the exterior of the container whereby said cutter element may be manipulated from without the container.

8. The container of claim 7, wherein said grasping element is attached to one of said triangles adapted to comprise a portion of said pour spout, whereby said portion of said end closure may be reformed into said pour spout and said liner may be ruptured by a single displacement of said grasping element.

9. The container of claim 3, wherein said sidewall is formed of paperboard or a similar material.

10. The container of claim 9 and a substantially planar metal end panel attached to said sidewall at the end thereof opposite said end closure.

11. The container of claim 3, wherein N is 6.

12. A composite container for fluent products, of the type including a rigid cylindrical body of paperboard or the like and a rigid end panel attached thereto; the improvement comprising an end closure integrally formed from a folded distal end portion of said body, a product-compatible liner disposed within said body, and means carried between said liner and said body for rupturing said liner to provide for passage of product therethrough.

13. The container of claim 12, wherein said end closure, prior to opening, lies substantially in a plane perpendicular to said body of the container, whereby an object having a planar base may be readily stacked upon said container.

14. The container of claim 12, wherein said cylindrical body is defined about a principal axis and said end closure comprises a plurality of interconnected segments formed in said distal end portion and folded transverse the principal axis and meeting thereat, with certain of said segments being adhesively bonded in superposed relation to adjacent segments to retain said end closure in a normally closed condition, a portion of said adhesive bonds being relatively permanent in nature and the remainder being adapted for debonding during opening of said end closure.

15. The container of claim 14, wherein said rupturing means comprises a cutter element hingedly attached to said body and a flexible grasping element attached to said cutter element and extending through said meeting point of said segments to the exterior of said container.

16. The container of claim 14, wherein said segments associated with said debondable adhesive bonds are reformable into a pour spout subsequent to opening of said end closure.

17. The container of claim 15, wherein said grasping element is attached to one of said elements associated with said debondable adhesive bonds, whereby said end closure may be opened, said pour spout erected and said liner ruptured by a single displacement of said grasping element.

18. The container of claim 1, wherin said end closure comprises first and second portions disposed in abutting relation transverse the principal axis, said first portion being relatively permanently fixed in position, said second portion being displaceable and adapted for reformation as an integral pour spout, said reformation of said second portion providing an opening in said end closure.

19. The container of claim 12, wherein said rupturing means comprises a cutter element hingedly attached to said body and a flexible grasping element attached to said cutter element and extending through an opening in said end closure to the exterior of said container.

* * * * *